US008727006B2

(12) United States Patent
Mango

(10) Patent No.: US 8,727,006 B2
(45) Date of Patent: May 20, 2014

(54) DETECTING AND REMEDYING HYDROGEN STARVATION OF CATALYTIC HYDROCARBON GENERATION REACTIONS IN EARTHEN FORMATIONS

(75) Inventor: Frank D. Mango, Houston, TX (US)

(73) Assignee: Petroleum Habitats, LLC, Houston, TX (US)

( * ) Notice: Subject to any disclaimer, the term of this patent is extended or adjusted under 35 U.S.C. 154(b) by 234 days.

(21) Appl. No.: 13/101,124

(22) Filed: May 4, 2011

(65) Prior Publication Data

US 2011/0272162 A1 Nov. 10, 2011

Related U.S. Application Data

(60) Provisional application No. 61/331,206, filed on May 4, 2010.

(51) Int. Cl.
*E21B 43/16* (2006.01)
*E21B 47/00* (2012.01)

(52) U.S. Cl.
USPC ..... 166/309; 166/250.01; 166/401

(58) Field of Classification Search
None
See application file for complete search history.

(56) References Cited

U.S. PATENT DOCUMENTS

| | | | | |
|---|---|---|---|---|
| 2,387,513 | A | | 10/1945 | Hocott |
| 2,551,449 | A | | 5/1951 | Menke |
| 2,705,417 | A | | 4/1955 | Romo et al. |
| 2,768,793 | A | | 10/1956 | Bonner |
| 2,854,396 | A | | 9/1958 | Hunt et al. |
| 3,033,287 | A | | 5/1962 | Bond |
| 3,180,902 | A | | 4/1965 | Andersen et al. |
| 3,322,195 | A | | 5/1967 | Brown et al. |
| 3,343,917 | A | | 9/1967 | Friedman |
| 3,428,431 | A | | 2/1969 | Billings |
| 3,719,453 | A | | 3/1973 | Erdman |
| 3,752,984 | A | | 8/1973 | Scott et al. |
| 3,929,615 | A | * | 12/1975 | Linden et al. ..... 208/408 |
| 3,934,455 | A | | 1/1976 | Harrisberger |
| 4,081,675 | A | | 3/1978 | Bartz |
| 4,108,552 | A | | 8/1978 | Austin et al. |
| 4,205,956 | A | | 6/1980 | Stedman |
| 4,334,882 | A | | 6/1982 | Edwards |
| 4,345,912 | A | | 8/1982 | Bartz |
| 4,352,673 | A | | 10/1982 | Espitalie et al. |
| 4,426,452 | A | | 1/1984 | Lasoski |
| 4,587,847 | A | | 5/1986 | Malmqvist et al. |
| 4,681,854 | A | | 7/1987 | Feazel |
| 4,701,270 | A | | 10/1987 | Bullen et al. |
| 4,792,526 | A | | 12/1988 | Ouellette et al. |
| 4,798,805 | A | | 1/1989 | Issenmann |
| 5,082,787 | A | | 1/1992 | Nolte et al. |
| 5,097,123 | A | | 3/1992 | Grau et al. |
| 5,174,966 | A | | 12/1992 | Durand et al. |
| 5,178,837 | A | | 1/1993 | Crisp |

(Continued)

OTHER PUBLICATIONS

International Search Report and Written Opinion for PCT/US2011/035276 mailed Aug. 11, 2011.

(Continued)

*Primary Examiner* — Zakiya W Bates
(74) *Attorney, Agent, or Firm* — Winstead PC

(57) ABSTRACT

Methods and apparatus for promoting the production of oil and/or gas from organic carbon-rich sedimentary rocks in a subterranean formation. Aspects of the method comprise detecting hydrogen starvation in the formation and remedying the hydrogen starvation.

10 Claims, 4 Drawing Sheets

(56) References Cited

U.S. PATENT DOCUMENTS

| | | | | |
|---|---|---|---|---|
| 5,389,550 | A | 2/1995 | Ishida et al. | |
| 5,769,165 | A | 6/1998 | Bross et al. | |
| 6,225,359 | B1 | 5/2001 | O'Rear et al. | |
| 6,666,067 | B2 | 12/2003 | Stolper | |
| 6,739,394 | B2 | 5/2004 | Vinegar et al. | |
| 7,153,688 | B2 | 12/2006 | Mango | |
| 7,395,691 | B2 * | 7/2008 | Sterner et al. | 73/19.09 |
| 7,435,597 | B2 | 10/2008 | Mango | |
| 7,608,170 | B1 | 10/2009 | Ousey | |
| 7,845,414 | B2 | 12/2010 | Mango | |
| 2002/0002318 | A1 | 1/2002 | O'Rear et al. | |
| 2002/0058581 | A1 | 5/2002 | Youngman et al. | |
| 2004/0159149 | A1 * | 8/2004 | Williams et al. | 73/152.23 |
| 2004/0166582 | A1 | 8/2004 | Prinzhofer et al. | |
| 2005/0082058 | A1 | 4/2005 | Bustin et al. | |
| 2005/0250209 | A1 | 11/2005 | Mango | |
| 2006/0065400 | A1 | 3/2006 | Smith | |
| 2006/0117841 | A1 | 6/2006 | Mango | |
| 2006/0121615 | A1 | 6/2006 | Mango | |
| 2006/0191686 | A1 | 8/2006 | Blauch et al. | |
| 2008/0115935 | A1 | 5/2008 | Mango | |
| 2009/0014179 | A1 | 1/2009 | Mango | |
| 2010/0200234 | A1 | 8/2010 | Mango | |
| 2011/0077445 | A1 | 3/2011 | Mango | |
| 2012/0059587 | A1 * | 3/2012 | Marsh et al. | 702/8 |

OTHER PUBLICATIONS

Bassett et al., Metathesis of Alkanes and Related Reactions, Accts. Chem. Res., 2010, 43, 323-334.

Kravtsov, Zakonomern Obraz Razmeshcheniya Prom Mestorozhd Nefti Gasa (1975), 38-48, Kaukova Dumka, Kiev, USSR.

Espitalie et al., "Role of the mineral matrix during kerogen pyrolysis", Org Geochem 1984, 6, 365-379 and 381-382.

Nikol'Skii, "Crystallization conditions for some reduced mineral phases and their petrogenetic importance", Vulkanologiya i Siesmologiya 1984, 45-58.

Ungerer et al., "Extrapolation of the kietics of oil and gas formation from laboratory experiments to sedimentary basins", Nature 1987, 327, 52-54.

Dembicki, "The effects of the mineral matrix on the determination of kinetic parameters using modified rock eval pyrolysis", Organic Geochemistry 1992, 18, 531-539.

Braun et al., "Oil and gas evolution kinetics for oil shale and petroleum source rocks determined from pyrolysis-TWMS data at two heating rates", Energy & Fuels 1992, 6, 468-474.

Barth et al, "Estimating kinetic parameters for generation of petroluem and single compounds from hydrous pyrolysis of source rocks", Energy & Fuels 1993, 7, 100-110.

Mango, "Transition metal catalysis in the generation of petroluem and natural gas. progress report", 1992 OSTI as DE93019698; NTIS.

Mango, "Role of transition-metal catalysis in the formation of natural gas", Nature 1994, 368, 536-538.

Reynolds et al., "Comparison of kinetic analysis of source rocks and kerogen concentrates", Organic Geochemistry 1995, 23, 11-19.

McNeil et al., "Thermal stability of hydrocarbons: laboratory criteria and field examples", Energy & Fuels 1996, 10, 60-67.

Mango, "Transition metal catalysis in the genreation of natural gas", Organic Geochemistry 1996, 24, 977-984.

Mango, "Transition metal catalysis in the generation of petroleum and natural gas", 1993, OSTI as DE-FG05-92ER14295; NTIS.

Knauss et al., "hydrous pyrolysis on new albany and phosphoria shales: production kinetics of carboxylic acids and light hydrocarbons and interactions between the inorganic and organic chemical systems", Organic Geochemistry 1997, 27, 477-496.

Mango, "The catalytic decomposition of petroleum into natural gas", Geochimica et Cosmochimica Acta 1997, 61, 5347-5350.

Dieckmann et al., "Kinetics of petroleum generation and cracking by programmed-temperature closed-system pyrolysis of toarcian shales", Fuel 1998, 77, 23-31.

Schaefer et al., "Reaction kinetics of gas generation in selected source rocks of the west siberian basin: implications for the mass balance of early-thermogenic methane", Chemical Geology 1999, 156, 41-65.

Michels et al., "Understanding of reservoir gas compositions in a natural case using stepwise semi-open artificial maturation", Marine and Petroleum Geology 2002, 19, 589-599.

Ramaswamy, "A field evidence for mineral-catalyzed formation of gas during coal maturation", Oil & Gas Journal 2002, 100, 32-36.

Starobinets et al., "Study of the catalytic effect of rocks of different lithological composition on the formation of gaseous hydrocarbons from natural organic compounds", Institut Geologii i Razvedki Neftyanykh i Gazovykh Mestorozhdenii 1975, 17, 108-114.

Rafiqul, "Study on the formation of gas phase during thermal alteration of petroleum" Journal of Bangladesh Academy of Sciences 1995, 19, 97-104.

Jin et al., "Catalysis and hydrogenation: volcanic activity and hydrocarbon generation in rifts basins, eastern china", Applied Geochemistry 1999, 14, 547-558.

Jin et al., "Volcanic and thermal-water activities and hydrocarbon generations in the rift basins, eastern china" Chinese Journal of Geology 2003, 38, 342-349.

Lee, D.S.; "Determination of nickel in seawater by carbonyl generation" Analytical Chemistry 1982; 54,1182-1184.

Drews, W., et al.; "Flow-injection system for the determination of nickel by means of MIP-OES after conversion to Ni) CO)4", Fresenius' Zeitschrift fuer Analytische Chemie 1989, 332, 862-865.

Schaefer, W., "Determination of traces of tetracarbonylnickel and pentacarbonyliron in streams of fluids such as syntheis gas", Fresenius' Zeitschrift fuer Analytische Chemie 1989, 335, 785-790.

Mihaylov, M., et al.; "Formation of Ni(CO)4 during the interaction between CO and silica-supported nickel catalyst: an FTIR spectroscopic study", Catalysis Letters 2001; 76, 59-63.

Mango, "The origin of light hydrocarbons," Geochimica et cosmochimica Acta, 2000, 64, 1265-1277.

Mango, "The light hydrocarbons in petroleum: a critical review," Org. Geochem., vol. 26, No. 7/8, pp. 417-440, 1997.

Mango, "Methane concentrations in natural gas: the genetic implications," Org. Geochem., 32, 1283-1287, 2001.

Air Products & Chemicals, Inc., et al.; Excert of Topical Report entitled "Alternative Fuels Field Test Unit Support to Kingsport LPMEOH(TM) Demonstration Unit," (Dec. 1997) p. 17 only.

Excerpt from website http://www.angelfire.com/treklgalactic_mining/carbonyl.htm, "Near Earth Asteroid Utilization and Carbonyl Metallurgical Processes," (Apr. 2002) 2 pgs.

Hunt, Petroleum Geochemistry and Geology, 2nd ed., W. H. Freeman, New York., Chapter 7, 1996.

Paine et al., "Geology of natural gas in South Louisiana," American Association of Petroleum Geologists, Memoir 9, vol. 1, Natural Gases of North America, Beebe, B. W., Editor, 376-581, 1968.

Price, "Thermal stability of hydrocarbons in nature: Limits, evidence, characteristics, and possible controls," Geochimica et Cosmochimica Acta, 57:3261-3280, 1993.

Littke et al., "Gas generation and accumulation in the West Siberian basin", AAPG Bull., 83:1642-1665, 1999.

Domine et al., "Towards a new method of geochemical kinetic modelling: implications for the stability of crude oils", Organic Geochemistry, 28:597-612, 1998.

Domine et al., "Up to what temperature is petroleum stable? New insights from 5200 free radical reaction model," Organic Geochemistry, 33:1487-1499, 2002).

Mallinson et al., "Detailed chemical kinetics study of the role of pressure in butane pyrolysis," Industrial & Engineering Chemistry, Research, 31:37-45, 1992.

Burnham et al., "Unraveling the kinetics of petroleum destruction by using 1,213C isotopically labeled dopants," Energy & Fuels, 9:190-191, 1995.

Jackson et al., "Temperature and pressure dependence of n-hexadecane cracking," Organic Geochemistry, 23:941-953, 1995).

Mango, et al., "The carbon isotopic composition of catalytic gas: A comparative analysis with natural gas," Geochimica et Cosmochimica Acta, 63:1097-1106 (Jan. 1999).

(56) References Cited

OTHER PUBLICATIONS

Mango, "Transition metal catalysis in the generation of petroleum and natural gas," Geochimica et Cosmochimica Acta. 56:553-555, 1992).
Boggs, Jr., "Principles of Sedimentology and Stratigraphy," Prentice-Hall, Inc., 2nd ed., pp. 165 and 195 (1995).
Medina, et al., "Low temperature iron- and nickel-catalyzed reactions leading to coalbed gas formation," Geochimica et Cosmochimica Acta, 64:643-649 (Feb. 2000).
Galbreath, et al., "Chemical Speciation of Nickel in Residual Oil Ash," Energy & Fuels, 12:818-822 (Jun. 1998).
Seewald, "Organic-inorganic interactions in petroleum-producing sedimentary basins," Nature, 426-327-333 (Nov. 2003).
Mann, et al., Organic Facies Variations, Source Rock Potential, and Sea Level Changes in Cretaceous Black Shales of the Quebrada Ocal, Upper Magdalena Valley, Colombia, American Association of Petroleum Geologists Bulletin, 81:556-576 (Apr. 1997).
Cruickshank, et al., "Mineral Deposits at the Shelfbreak," SEPM Special Publication No. 33, (Jun. 1983) pp. 429-431.
Snowdon, L.R., et al.; "Identification of Petroleum Source Rocks Using Hydrocarbon Gas and Organic Carbon Content"; Geological Survey of Canada; Dept. of Energy, Mines and Resources; Paper 72-36; 1972.
Sams et al., "Validatoin of a geochemical logging tool for in situ major element analysis in boreholes using inductively coupled plasma atomic emission spectrometry", Analyst 1995, 120, 1407-1413.
International Search Report and Written Opinion, PCT/US07/078660, Jul. 23, 2009.
International Search Report and Written Opinion, PCT/US07/60215, dated Sep. 27, 2007.
International Search Report and Written Opinion, PCT/US09/069753, dated Sep. 9, 2010.
Mango et al., 2009, Low-Temperature Gas Generated from Marine Shales, Geochem. Trans., 2009 10:3, (DOI:10.1186/1467-4866-10-3).
Fox, "E&P Industry Chokes Back", 2010, http://stocks.investopedia.com/stock-analysis/2010/E--P-Industry-Chokes-Back-NOG-HK-DVN-STR0312.aspx.
Mango et al, 2009, Natural Gas at Thermodynamic Equilibrium: Implications for the Origin of Natural Gas, Geochem. Trans. 10:6. (DOI:10.1186/1467-4866-10-6.
Mango et al., 2009a, Low-Temperature Gas from Marine Shales: Wet Gas to Dry Gas Over Experimental Time, Geochem. Trans. 10:10, (DOI:10.1186/1467-4866-10-10).
Mango et al., 2010, Metathesis in the Generation of Low-Temperature Gas in Marine Shales, Geochem. Trans. 11:1, (DOI:10.1186/1467-4866-11-1).
Mango et al., 2010, Natural Catalytic Activity in a Marine Shale for Generating Natural Gas, Proceedings Royal Society A, published online Apr. 21, 2010; 466, 3527-3537, doi: 10.1098/rspa.2010.0032).
International Search Report and Written Opinion, PCT/US11/035276, dated Aug. 11, 2011.

* cited by examiner

DETECTING AND REMEDYING HYDROGEN STARVATION OF CATALYTIC HYDROCARBON GENERATION REACTIONS IN EARTHEN FORMATIONS

RELATED APPLICATIONS

This application claims the benefit of U.S. provisional application No. 61/331,206 filed on May 4, 2010.

BACKGROUND

This section provides background information to facilitate a better understanding of the various aspects of the invention. It should be understood that the statements in this section of this document are to be read in this light, and not as admissions of prior art.

Oil is known to progress to natural gas in deep sedimentary basins. A conventional view of oil-to-gas conversion is that oil thermally cracks to gas (thermal gas) at temperatures between 150° C. and 200° C. Temperatures in this range are commonly observed geologically where most oil-to-gas is observed. However, various kinetic models based on thermal gas have had only marginal predictive success in drilling operations. There is mounting scientific evidence suggesting that oil should not crack to gas, even over geologic time periods, at temperatures between 150° C. and 200° C., the range within which most so-called thermal gas is formed. For example, gas produced by industrial thermal cracking of hydrocarbons is typically severely depleted in methane and does not resemble the natural gas distributed in the earth.

The inventor of the present invention has previously disclosed that sedimentary rocks (e.g., geological formations) possess natural or intrinsic catalytic activity that generates natural gas (e.g., catalytically generated gas) in subterranean environments from heavy hydrocarbons. The inventor has disclosed methods for promoting (e.g., enhancing) the natural catalytic generation of light hydrocarbons in subterranean formations and in surface reactor systems, for example in WO2007/082179, U.S. Pat. No. 7,845,414, US 2011/0077445, and US 2010/0200234, all of which are incorporated herein by reference. Carbonaceous sedimentary rocks (i.e., source rocks) include, for example, shales containing kerogens (siliceous and carbonate), coals, tar sands, and reservoir rocks containing residual oil. Non-carbonaceous sedimentary rocks include, for example, sandstones and carbonate rocks, which contain inorganic carbon. Both carbonaceous sedimentary rocks and non-carbonaceous sedimentary rocks may contain transition metals. According to aspects of these prior disclosures, the source rocks comprise heavy hydrocarbons and catalytic sites (e.g., transition metals) that react generating catalytic gas.

Catalytic conversion of hydrocarbons into natural gas mediated by transition metals is an explanation for geologic formation of gas. For example, crude oils can be catalytically converted to gas over zero-valent transition metals (ZVTM) such as, for example, Ni, Co, and Fe under anoxic conditions at moderate temperatures (150° C.-200° C.). The catalytically-formed gas is typically identical or substantially similar to geologically-formed gas. According to these various methods of generating catalytic gas in subterranean formations and in surface reactors, an anoxic stimulation gas is injected into the subterranean formation or through the source rock in the surface reactor. According to the prior teachings, the stimulation gas, which may be a hydrocarbon gas, is not a reactant in the catalytic gas generation process. The stimulation gas is only used as an agent to carry hydrocarbons in the source rock to the catalytic sites. In other words, the use of a hydrocarbon stimulation gases is no different from inert gases such as nitrogen, helium, and carbon dioxide. The stimulation gas injected into the subterranean formation, via a well, is recovered from the well in the same molecular form.

There is continuing desire to identify sources of hydrocarbons as an energy source. There is a still further desire to promote the production of oil and gas to increase the production life of wells.

SUMMARY

According to one or more aspects of the invention, a method for generating gas in a subterranean formation comprises injecting a hydrocarbon gas to a subterranean source rock disposed in the reactor vessel; and producing a hydrocarbon product from subterranean source rock generated in response to catalytic activity in the source rock.

A method of producing gas from a subterranean shale formation according to another aspect of the invention comprises detecting hydrogen starvation in the shale formation and remedying the hydrogen starvation.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
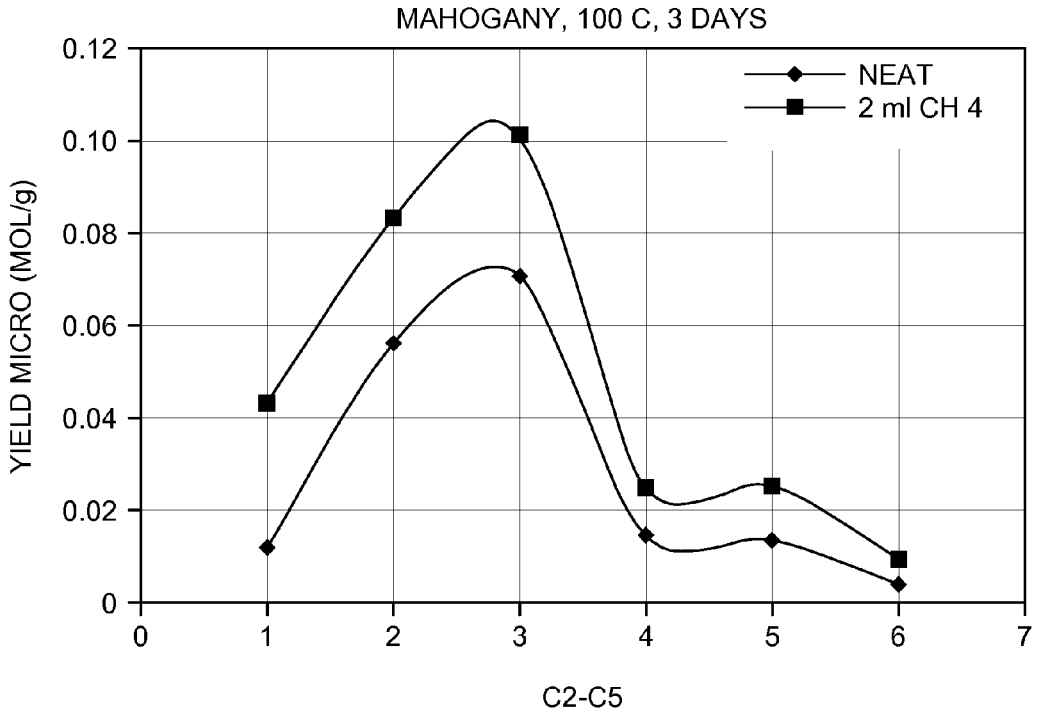
FIG. 1 is a plot showing the yield of C2 to C5 from a Mahogany shale in response to the addition of methane.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

While most of the terms used herein will be recognized by those of ordinary skill in the art, the following non-exhaustive list of terms is provide below to aid in understanding the present disclosure.

"Gas" as used herein, refers to natural gas. "Gas" may be utilized in particular to refer to the C1-C5 hydrocarbons. Various example and embodiments of the present disclosure are described with reference to methane for purposes of brevity and convenience. "Inert gas" as used herein, refers to non-reactive gases such as, for example, helium, argon and nitrogen.

"Sedimentary rock" as used herein, refers to, for example, rock formed by the accumulation and cementation of mineral grains transported by wind, water, or ice to the site of deposition or chemically precipitated at the depositional site. Sedimentary rocks comprise, for example, reservoir rocks, source rocks, and conduit rocks. "Reservoir rocks" as used herein refer to, for example, subterranean material that traps and sequesters migrating fluids (e.g., from a reservoir formation). "Source rocks" as used herein refer to, for example, rocks within which petroleum is generated and either expelled or retained. "Conduit rocks" as used herein refer to, for example, rocks through which petroleum migrates from its source to its final destination (e.g., reservoir rock). A "sedimentary basin" as used herein, refers to, for example, a large accumulation of sediment, as in, for example, sedimentary rock. "Outcrop rocks" as used herein refer to, for example, segments of bedrock exposed to the atmosphere.

"Target reservoir" as used herein, refers to, for example, a drilling prospect in a sedimentary basin or other geological formation containing sedimentary rocks and believed to contain petroleum (e.g., oil and/or gas).

"Gas habitat" as used herein, refers to, for example, sedimentary rock within a sedimentary basin that is sufficiently catalytic to convert 90% or more of its contained oil to gas over a specified time interval at a given temperature.

"Oil habitat" as used herein, refers to, for example, sedimentary rock within a sedimentary basin that is not sufficiently catalytic to convert 90% or more of its contained oil to gas over a specified time interval at a given temperature.

"Catalytic gas or hydrocarbon generation" as used herein, refers generally to, for example, geological processes in which crude oil containing higher molecular weight hydrocarbons is converted into natural gas containing lower molecular weight hydrocarbons such as, for example, methane and other C2-C5 hydrocarbons. "Catalytically-generated gas (CGG) or catalytically generated hydrocarbons (CGHC)" as used herein, refers to, for example, catalytically-generated methane (CGM) generated via a catalytic decomposition of a carbonaceous material (e.g., a hydrocarbon) catalyzed by ZVTM or LVTM. Catalytically-generated hydrocarbons may be produced (i.e., generated) in subterranean environments as well as surface reactors.

"Intrinsic catalytic activity" or "natural catalytic activity" refers to, for example, the catalytic activity for oil-to-gas conversion of a rock sample, without the rock sample being compromised by exposure to oxygen. Intrinsic catalytic activity correlates with the native catalytic activity of the rock sample in the source reservoir from which the rock sample was obtained. In some embodiments of the disclosure, the intrinsic catalytic activity may correlate with the amount of gas capable of being catalytically-generated in the source reservoir.

"Transition metal" as used herein, refers to, for example, metals residing within the "d-block" of the Periodic Table. Specifically, these include elements 21-29 (scandium through copper), 39-47 (yttrium through silver), 57-79 (lanthanum through gold), and all known or unknown elements from 89 (actinium) onward. Illustrative transition metals with relevance in catalytic oil-to-gas conversion include, for example, iron, cobalt and nickel.

"Low-valent transition metals (LVTMs)" as used herein refer to, for example, transition metals that are in a low oxidation state. A low oxidation state for LVTMs may include, for example, a 0, +1, +2 or +3 oxidation state. "Zero-valent transition metals (ZVTMs)" as used herein refer to, for example, transition metals in their zero-oxidation (i.e., neutral) state.

The inventor has discovered, and discloses herein, evidence that methane promotes higher yields of light hydrocarbons. For example, methane added to Mahogany Shale at 100° C. almost doubles the yield of C2-C4 hydrocarbons (Example 1). Butane added to a Floyd Shale at 50° C. has a similar effect (Example 2). It is proposed that hydrogen delivery through ½ $CH_4 + Cn \rightarrow Cn\text{-}x + Cx + \frac{1}{2} C$ [Reaction 1] as the source, where Cn, Cn-x, and Cx are saturated hydrocarbons. These results suggest higher yields of catalytic gas by injecting methane into poorly performing wells and/or injecting methane into surface catalytic hydrocarbon generation systems (e.g., surface reactors).

According to one or more aspects of the present disclosure, the injected methane carries hydrogen to the source rock for the catalytic reaction. Thus, if the source rock has limited hydrogen available (e.g., hydrogen starvation) for the catalytic reaction, injecting methane can provide the needed hydrogen. This is contrary to previous disclosures wherein gas is injected (e.g., flowed to or through) the source rock to serve only as an agent to carry heavy hydrocarbons to the catalytic sites and/or to introduce catalysts to the source rock. The added methane and butane in the experiments promote higher yields by shedding hydrogen to the higher hydrocarbons, thus cleaving carbon-carbon bonds and generating lighter hydrocarbons. The carbon injected under these circumstances is not recovered, it remains in the source rock.

The higher partial pressures of methane, for example, translate into higher partial pressures of hydrogen, thus higher conversions to light hydrocarbons. Example 3 discloses field evidence of high methane pressures promoting light hydrocarbon generation. A well producing unconventional gas from Mancos Shale was closed for routine maintenance. Gas pressure went from 50 psi under flow to 250 psi on closure. Gas compositions before and after shut-in show striking differences and clear evidence that higher gas pressures promote light hydrocarbon generation: <1% ethane through butanes at 50 psi before closure, and ~10% ethane through butanes after 2.5 hours of well shut-in (250 psi after closure). There can be little doubt about the source of these hydrocarbons. They were at thermodynamic equilibrium in methane, ethane, and propane (Table 1), and only catalytic generation under closed conditions will bring these hydrocarbons to equilibrium under these conditions. The possibility that hydrocarbons at equilibrium might result from some other, non-catalytic process, is inconceivable.

In such cases, injecting sufficient gas (e.g., light hydrocarbons, methane, ethane, propane, and butane) to reach critical pressure can bring the reactor to steady-state and sustained generation. In this example, gas pressure is used to optimize performance in order to sustain stable steady-state catalysis to completion. This technology should be useful in all places where catalytic light hydrocarbon generation is curtailed by insufficient gas pressures to sustain conversion. It can be particularly powerful in unconventional oil generation where conversion rates are suppressed by low gas pressures. Injecting gas can increase well performance in two ways: 1) providing better fluid flow, and 2) promoting higher yields of light oils.

What distinguishes this technology from others cannot be overstated. It focuses on the catalytic reaction exclusively. High hydrocarbon pressure promotes the conversion of heavy hydrocarbons to light hydrocarbons through the natural catalytic process in which methane is a reactant. No other process does this. Nothing in the literature would suggest that injecting methane into a poorly performing well (i.e., subterranean source rock) would have a dramatic effect on performance and net hydrocarbon yields. In all of the cases currently disclosed, gas is injected for physical, not chemical reasons. In no case other than what is proposed here, does the added hydrocarbon undergo a chemical change (e.g., $CH_4 \rightarrow C+2H_2$) resulting in the generation of producible light hydrocarbons. According to one or more aspects of the invention, methane can be a carrier of hydrogen to the catalytic reaction in the formation that generates hydrocarbons. Therefore, increasing the availability of hydrogen to the catalytic reaction in the formation can be facilitated by injecting methane into the formation and/or shutting in the well, temporarily, and thus increasing the methane and therefore hydrogen available for the catalytic reaction.

EXAMPLE 1

The Addition of Methane to Mahogany Shale, 100° C., 3 Days

Two 5 cc glass vials filled with argon and fitted with airtight screw caps with septa were charged with Mahogany Shale (Utah) ground to a powder (60 mesh) under argon. 2 cc of argon was injected into the first reactor (0.74 g shale) through two needles in and out of the reactor and 2 cc methane was injected into the second (0.86 g shale). The two reactors were then sealed with electrical tape and heated to 100° C. for 3 day. 2 cc gas was then removed from each reactor and analyzed for C1-C5 hydrocarbon products by a procedure described elsewhere. (See, Mango, F. D. & Jarvie, D. 2009, Low-Temperature Gas Generated from Marine Shales, Geochem. Trans. 10:3, (DOI:10.1186/1467-4866-10-3). FIG. 1 shows the distribution of hydrocarbon products. The second reactor contained 370 μg methane after the reaction while the first contained 0.23 μg methane. Methane addition increased the yield of C2-C5 hydrocarbons from 9.1 μg/g to 14.8 μg/g.

EXAMPLE 2

The Addition of n-Butane to Floyd Shale, 50° C., 24 Hours

Figure 2:
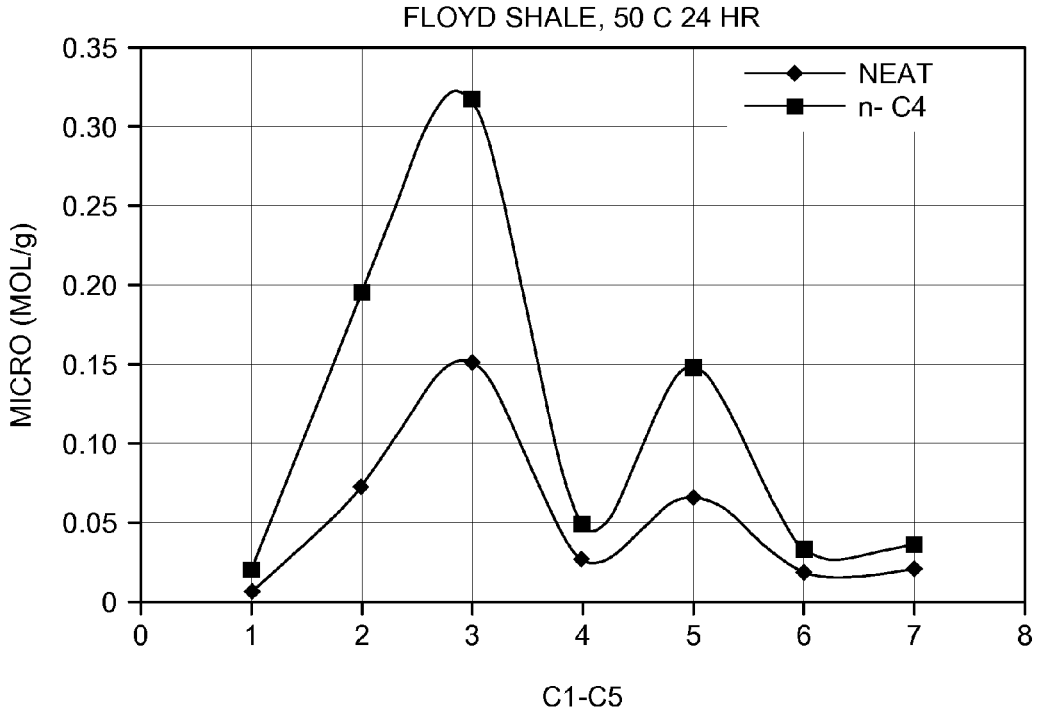
FIG. 2 is a plot showing the hydrocarbon yield from a Floyd shale in response to the addition of n-butane.

Two 5 cc glass vials filled with argon and fitted with airtight screw caps with septa were charged with Floyd Shale (Mango & Jarvie, Geochemical Transactions 2009, 10:3, id.) ground to a powder under argon (60 mesh). 2 cc of argon was injected into the first reactor (1.17 g shale) through two needles in and out of the reactor and 2 cc n-butane was injected into the second (0.87 g shale). The two reactors were then sealed with electrical tape and heated to 50° C. for 24 h. 2 cc of gas was then removed from each reactor and analyzed for C1-C5 hydrocarbon products by a procedure described elsewhere (Mango & Jarvie, Geochemical Transactions 2009, 10:3, id.). FIG. 2 shows the distribution of hydrocarbon products. The second reactor contained 7.5 μg n-butane after the reaction while the first contained 4.5 μg n-butane. Butane addition increased the yield of C1-C5 hydrocarbons (excluding n-butane) from 0.29 μg/g to 0.65 μg/g.

EXAMPLE 3

Effects of Well Shut-In, Unconventional Gas Production, Mancos Shale, Mesa County, CO Table 1 shows gas compositions before shut-in (50 psi, 3 days gas flow) and after shut-in (2.5 hours, 532 psi). The increase in C2 to C5 hydrocarbons from under 1% during gas flow at 50 psi to ~10% with shut-in at 532 psi can be attributed to the increase in gas pressure.

TABLE 1

Distribution (mol %) hydrocarbons in gas produced from Mancos Shale, Mesa County, CO.

| Mol % | Gas Flow, 50 psi, 3 days | After Shut-In 2.5 hr, 532 psi |
|---|---|---|
| Methane | 99.94 | 90.06 |
| Ethane | 0 | 3.59 |
| Propane | 0 | 3.45 |
| i-Butane | 0 | 0.89 |
| n-Butane | 0 | 0.36 |
| i-Pentane | 0 | 0.12 |
| n-Pentane | 0 | 0.10 |
| Hexanes+ | 0 | 0 |
| Carbon Dioxide | 0.03 | 0.20 |

The composition of methane, ethane, and propane after shut-in is Q = 24, $[(C1) * (C3)]/[(C2)^2]$.
Thermodynamic equilibrium at 50° C. is Q = 22.9.

This disclosure supports the claims that the introduction of light hydrocarbons (e.g., methane, ethane, propane, and butane) promote catalytic generation of hydrocarbons (i.e., oil and gas) in natural subterranean environments and in surface reactor generations systems as further disclosed herein.

Alkane metathesis is an extraordinary catalytic process in which one hydrocarbon is converted into its lower and higher homologues (Bassett et al., Metathesis of Alkanes and Related Reactions, *Accts. Chem. Res.,* 2010, 43, 323-334), wherein, saturated hydracarbons: i=1, 2, . . . n−1:

$$2C_n \Leftrightarrow C_{n-i}+C_{n+i} \quad \text{[Reaction 2]}$$

It is proposed by the inventor that metathesis plays a major role in catalytic gas generation. Metathesis actually proceeds through unsaturated intermediates, olefins and carbenes, and therefore requires reversible hydrogen transfer. If ethane metathesis occurs over the course of gas generation ($2C_2 \Leftrightarrow C_1+C_3$), it necessarily proceeds through unsaturated intermediates (i.e., $CH_2$, $C_2H_4$, and $C_3H_6$). Methane, ethane, and propane are thus potential hydrogen conduits (Reaction 3) that sustain hydrocarbon generation through hydrogen delivery (Reaction 5):

$$CH_4 \Leftrightarrow C+2[H_2] \quad \text{[Reaction 3]}$$

Carbon 13 exchange is the litmus test for metathesis (Bassett et al., Metathesis of Alkanes and Related Reactions,

*Accts. Chem. Res.,* 2010, 43, 323-334) (e.g., Reaction 4, $C_1$ is methane, $C_2$ is ethane, the superscripts denote carbon isotopes, $^{13}C_2$ is ethane with one atom of carbon 13 and one atom of carbon 12).

$$^{13}C_1+^{12}C_2 \Leftrightarrow {}^{12}C_1+^{13}C_2 \quad \text{[Reaction 4]}$$

It is disclosed herein that the facile exchange of carbon 13 between methane, ethane, propane, and butane over Mowry shale at 100° C. (Example 4), as definitive evidence of metathesis under gas generation conditions.

$C_{5+}$ hydrocarbon generation is disclosed herein by adding $C_1$-$C_4$ hydrocarbons to Mahogany shale at 100° C. (Example 5). This supports the claim that adding light hydrocarbons to source rocks stimulates oil and gas generation through metathetic intermediates, generating, in this example, substantial amounts of higher hydrocarbons.

This novel technology can be effective in subterranean deposits and in surface reactors. Organic-rich rock deposits are often shallow, at temperatures and pressures too low to sustain oil and gas generation. Where these rocks can be excavated, they can be converted to oil and gas in surface reactors under controlled conditions.

Figure 3:
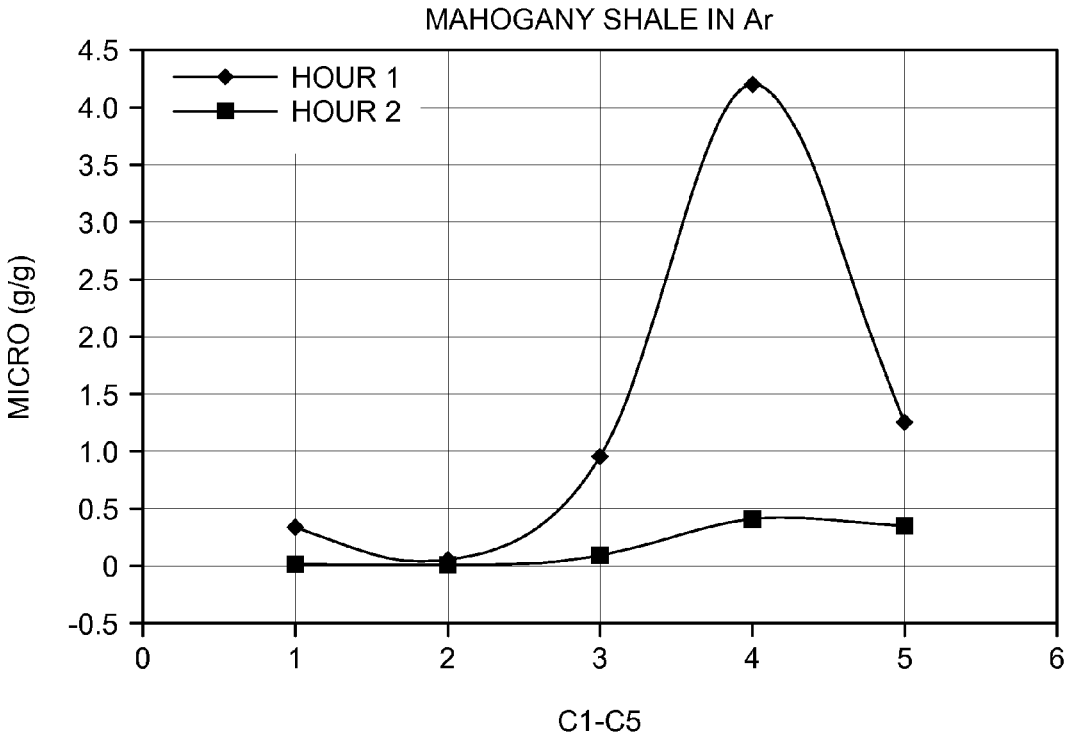
FIG. 3 is a plot showing the distributions of hydrocarbons generated from heating a Mahogany shale in argon.
Figure 4:
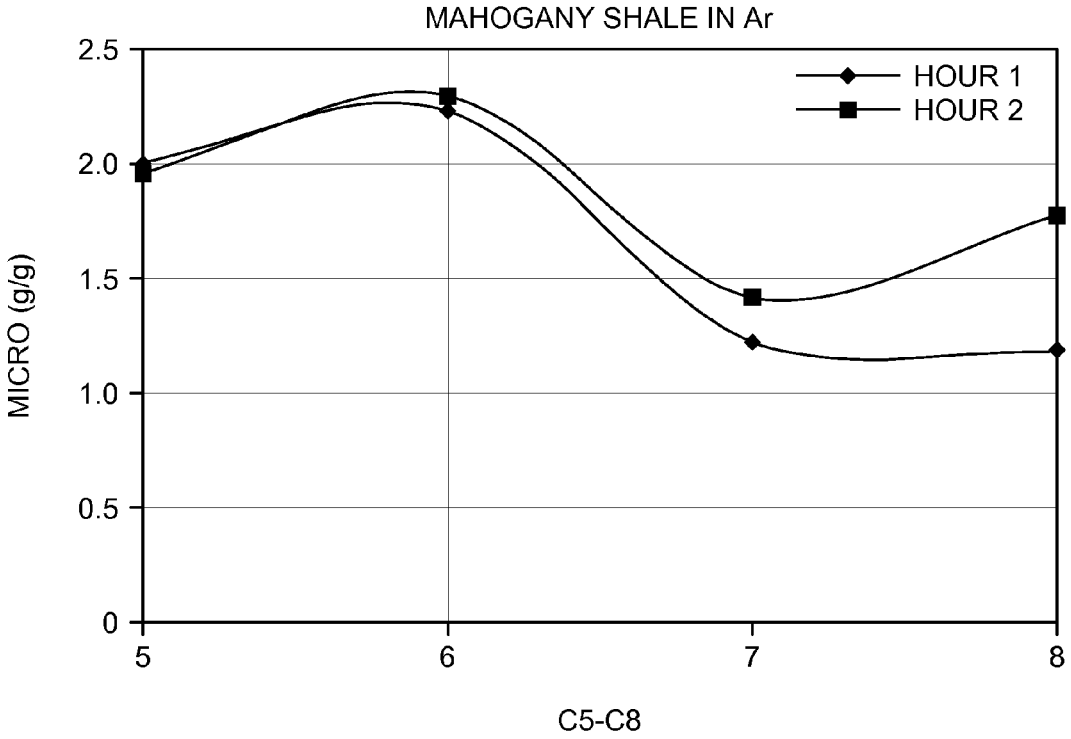
FIG. 4 is a plot showing the distribution of hydrocarbons generated from heating the Mahogany shale in C1-C4 hydrocarbons.

Marine shales typically generate catalytic gas in episodes with the initial episodes generating substantially more gas than subsequent episodes (Mango et al., *Geochem. Trans.* 2009, 10:3). Mahogany shale, for example, will generate about 10 μg/g $C_1$-$C_5$ hydrocarbons in the first hour of reaction (100° C.), and about half that amount in the second hour (Example 5). When the same reaction is carried out in light hydrocarbons ($C_1$-$C_4$), high yields are sustained in the second reaction and the distribution of products shifts markedly to higher hydrocarbons (FIG. 4, Example 5b). The inventor attributes the higher yields and higher product molecular weights to Reaction 5 ($C_1$ is methane, $C_n$ some higher hydrocarbon, where n>8, $C_m$ the lighter hydrocarbons generated by the shale ($C_5$-$C_8$ in FIG. 3), and C is a hydrogen-deficient carbon in some unspecified form):

$$C_1+2C_n \Rightarrow 2\,C_{n-m}+2C_m+C \quad \text{[Reaction 5]}$$

Methane, in this example, is the source of hydrogen: $CH_4 \Rightarrow 2H_2+C$. When reactions are carried out in argon, the conversion of higher hydrocarbons to lighter hydrocarbons is restricted to the hydrogen available in the source rock (e.g., shale). When the reactions are carried in $C_1$-$C_4$, hydrogen is delivered from the light hydrocarbons to the shale resulting in higher product yields (Reaction 5, Example 5).

EXAMPLE 4

Carbon 13 Exchange Between Methane (99% $^{13}C$) and an Equimolar Mixture of Ethane, Propane, iso-Butane, and n-Butane (99% $^{12}C$)

Two vials (5 ml) with screw caps and septa were charged with Mowry shale (~1 g) ground to powder under argon. Argon (5 ml) was withdrawn from the vials by syringe and replaced with 3 ml $C_2$-$C_4$. Isotopically light methane (99% $^{12}C$) was injected into one vial (1 ml) and heavy methane (99% $^{13}C$) into the second vial. Both vials were securely sealed with plastic tape and heated at 100° C. with occasional shaking for one hour. Gas was then extracted with syringe, injected into clean vials (dry-ice temperature) for transportation to an outside lab for isotopic analysis by GC-IR-MS. The results are shown in Table 2 where Vial 1 contains the light methane (99% $^{12}C$) and Vial 2 contains the heavy methane (99% $^{13}C$).

TABLE 2

Isotopic exchange between Methane (99% $^{13}C$) and an equimolar mixture of Ethane, Propane, iso-Butane, and n-Butane.

| Gas comp | Vial 1 Mowry 12C ppm | $\delta^{13}C$ (av) ‰ | $\delta^{13}C$ (error) ‰ | Vial 2 Mowry 13C ppm | $\delta^{13}C$ (av) ‰ | $\delta^{13}C$ (error) ‰ | $\Delta\delta^{13}C$ ‰ |
|---|---|---|---|---|---|---|---|
| Ethane | 2299 | −25.67 | 0.06 | 13610 | −22.52 | 0.18 | 3.15 |
| Propane | 1319 | −29.75 | 0.19 | 2875 | −25.78 | 0.11 | 3.97 |
| iso-Butane | 1036 | −29.59 | 0.19 | 1553 | −27.83 | 0.18 | 1.76 |
| n-Butane | 816 | −35.06 | 0.00 | 753 | −34.63 | 0.12 | 0.43 |

The reaction generated about 35 μg $C_5$ and $C_6$ hydrocarbons. Assuming that the same amount of $C_2$-$C_4$ hydrocarbons were generated (about 3% of the added $C_1$-$C_4$), the $^{13}C$ enrichment in the generated gas is estimated at about 0.5%. This would enrich the added gas from an initial overall $\delta^{13}C$ of −29.62% to the observed overall $\delta^{13}C$ of −24.69%. Thus, the generated $C_2$-$C_4$ gas had a $\delta^{13}C$ of around +265%.

EXAMPLE 5

The Effects of Hydrocarbons on the Generation of Catalytic Hydrocarbons in Mahogany Shale at 100° C.

EXAMPLE 5a

Reaction in Argon

About 1 g Mahogany Shale (Uinta Basin, Utah) was ground to a powder in argon, placed in a 5 ml vial with screw cap and septa, sealed, then heated at 100° C. for one hour. About 2 ml gas was removed from the vial with syringe and analyzed by gas chromatography. Two ml argon was injected to replace the extracted gas and the vial was heated for another hour at 100° C. and the product analyzed as before. This generated 6.9 μg $C_1$-$C_5$/g in the first hour and 0.89 μg $C_1$-$C_5$/g the second hour, with the respective distributions shown in FIG. 3.

EXAMPLE 5b

Reaction in Hydrocarbons

The reaction in Example 5a was repeated in a mixture of methane (2 ml) and an equimolar mixture of ethane, propane, iso-butane, and n-butane (3 ml). After heating 1 hour at 100° C., 2 ml was extracted with a syringe and analyzed. The 2 ml extracted was replaced with 2 ml methane, and the reactor again heated for one hour at 100° C. This generated 6.6 μg $C_5$-$C_8$ product the first hour and 7.4 μg $C_5$-$C_8$ in the second hour. For comparison to the reaction in argon, about 2 μg $C_5$ was generated the first hour and the same amount in the second hour in the hydrocarbon reaction. The reaction in argon produced 1.3 μg $C_5$ in hour 1 and 0.35 μg $C_5$ in hour 2. FIG. 4 shows the distribution of products in the reaction in hydrocarbons.

Figure 5:
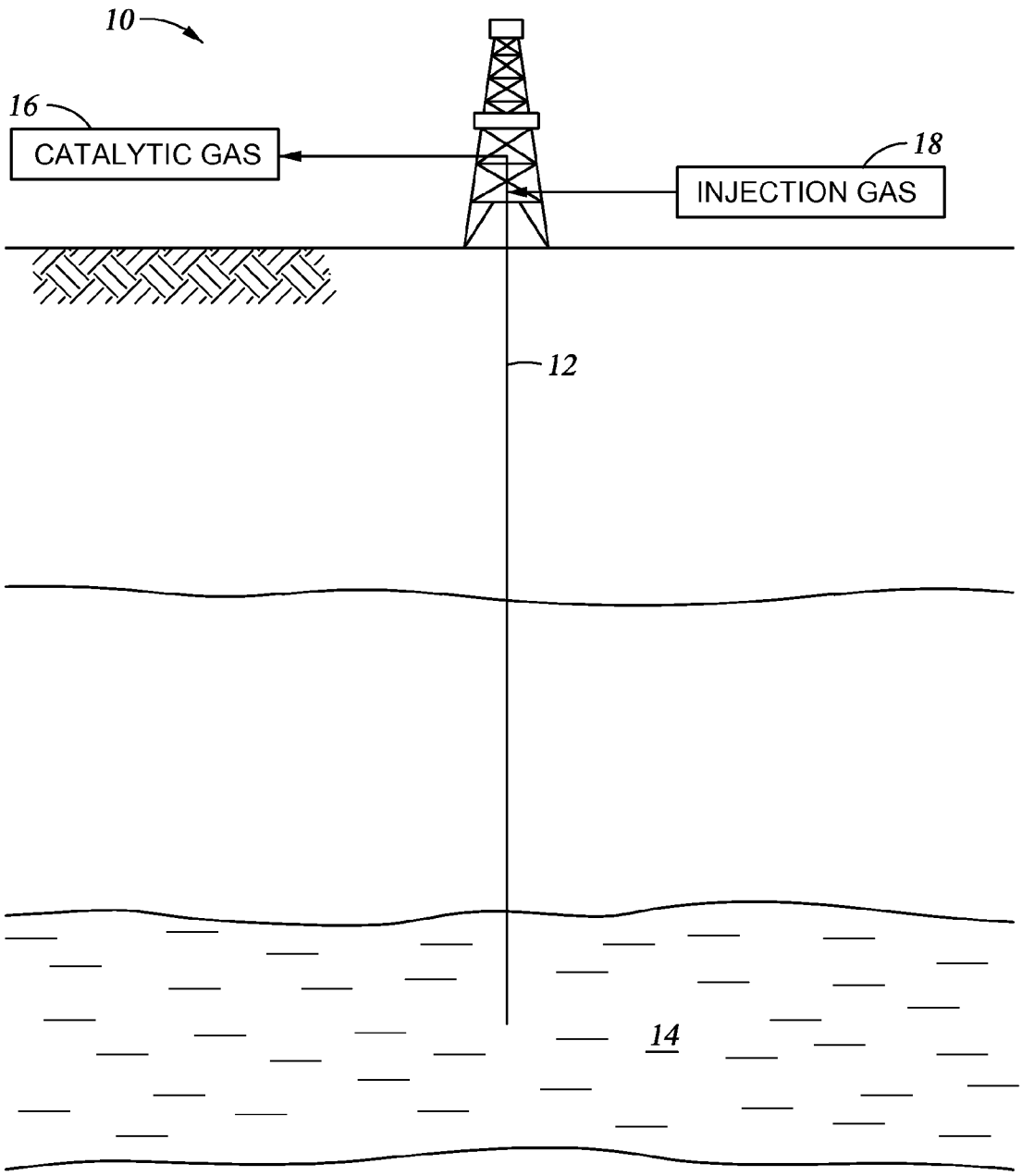
FIG. 5 is schematic illustration of an unconventional oil and gas well system according to one or more aspects of the invention.

The inventor has conducted field studies of gas wells in the Barnett and another shale field that show that this catalytic activity is occurring in real time during production, and is responsible for a substantial share of produced gas. It is believed by the inventor that at least half of the gas produced from Barnett shale wells is catalytically generated gas. Thus, source rocks can be viewed as self-contained chemical reactors (FIG. 5). FIG. 5 is a schematic illustration of an unconventional oil and gas well system generally denoted by the numeral 10. A well 12 (i.e., wellbore) is drilled into a subterranean formation 14 (i.e., source rock) referred to herein as a shale formation. Formation 14 comprises catalyst (e.g., transition metals) and feed (e.g., heavy hydrocarbons) for generating natural gas, depicted as produced gas 16, under the appropriate subsurface conditions. Like all chemical reactors, the subsurface catalytic activity is sensitive to pressure, temperature and flow rates. FIG. 5 further depicts a source of injection gas 18 which may be utilized to promote catalytic activity as further described below.

Figure 6:
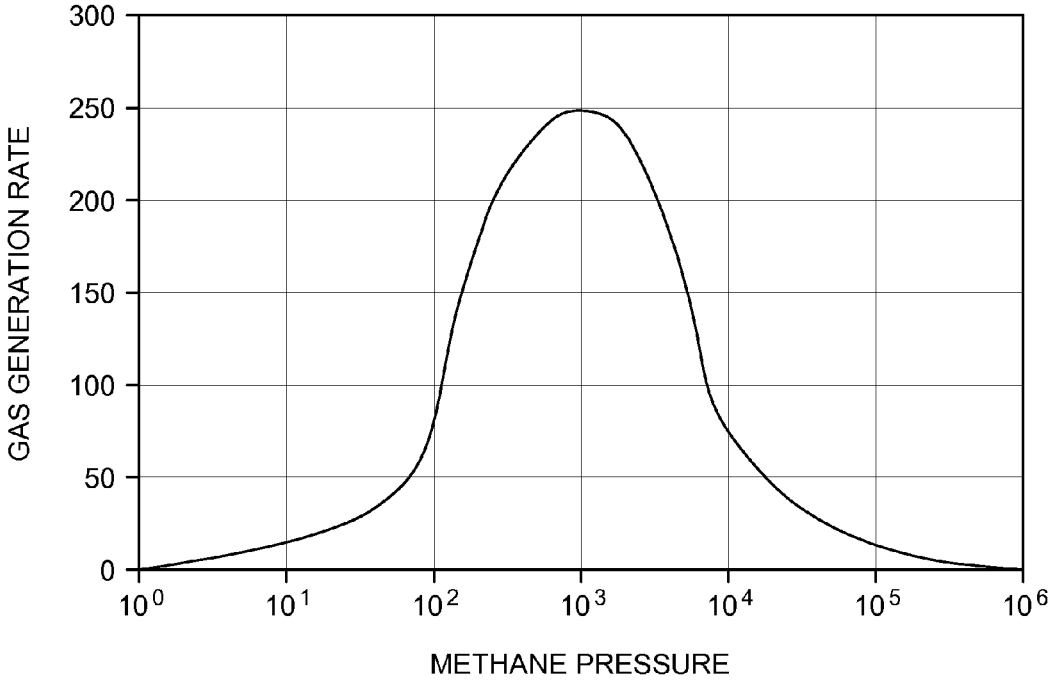
FIG. 6 is a conceptual plot illustrating that the catalytic reaction likely shuts down when methane pressures are very high, such as when the subterranean formation (e.g., shale) is in a "closed state" prior to drilling the well, and when the methane pressure is very low.

FIG. 6 is a conceptual plot asserting that the catalytic reaction likely shuts down when methane pressures are very high, such as when the subterranean formation (e.g., shale) is in a "closed state" prior to drilling the well, and when the methane pressure is very low.

It is well known by unconventional gas and oil (e.g., shale and coal) operators that shale wells follow very different production decline curves. It is also commonly observed that many shale wells experience sudden drops in production, followed by exponential production decline, referred to herein as "sudden failures." According to this disclosure, sudden failures are interpreted as arrests in the catalytic generation of gas or oil. What follows after such an arrest is production of "in place" gas that was generated at some prior time (e.g., historical gas in place). Gas in place production follows the traditional exponential dynamics of draining a reservoir with a fixed amount of gas or oil. Current industry practitioners consider these sudden failures relatively common, unpredictable and not well understood.

Operators of unconventional gas wells have recently observed that by reducing the flow rate of the gas wells, e.g., "choking back" the well, that the well's production yield can be boosted. It is believed in the industry that increased yield, when it occurs, is in response to changing some sort of mechanical parameter either in the well itself, or in the shale rock's fractures, although the finding is empirical in nature.

This disclosure proposes that hydrogen is a critical factor in the catalytic generation of gas and light oil in the subterranean formations. Accordingly, hydrogen is a key intermediate in the catalytic reaction, and the catalytic reaction will stop in formations with relative hydrogen insufficiencies. According to one or more aspects of the present disclosure, it is proposed that this state of "hydrogen starvation" is an important cause of sudden failures in shale formation wells. It is proposed herein that wells that have responded to "choking back" may be relatively hydrogen starved. Thus, these wells are responding to the resultant increases in methane pressure, as we believe methane carries hydrogen to the catalyst system. Following one or more aspects of the present disclosure, it is proposed that hydrogen starvation is a cause of why some shale formation wells never develop robust production performance.

A method, according to one or more aspects of the present invention, for detecting hydrogen starvation in a subterranean formation (e.g., shale, coal seam, etc.) is provided. In another embodiment, according to one or more aspects of the present invention, a method for remedying the hydrogen starvation of the subterranean formation is disclosed. According to one or more aspects of the invention, detecting and correcting hydrogen starvation in the subterranean formation can avert sudden failure in the generation of gas or light oil in the formation, and therefore the production of the well (e.g., wellbore) penetrating the formation. It is asserted herein that remedying the hydrogen starvation can transform some poor performing shale wells into average or better performers in terms of the amount of gas or light oil generated.

Diagnostic tests for detecting or predicting the development of hydrogen starvation states in shale (or coal) wells include, without limitation, detecting the occurrence of chaotic fluctuations in production rates, methane compositions, or downhole/reservoir temperatures; detecting declines in the ratio of methane/C2-C6 over time; detecting an increase in the concentration of olefins in the gas and/or light oil produced from the formation; and detecting a decrease in hydrogen partial pressures.

Figure 7:
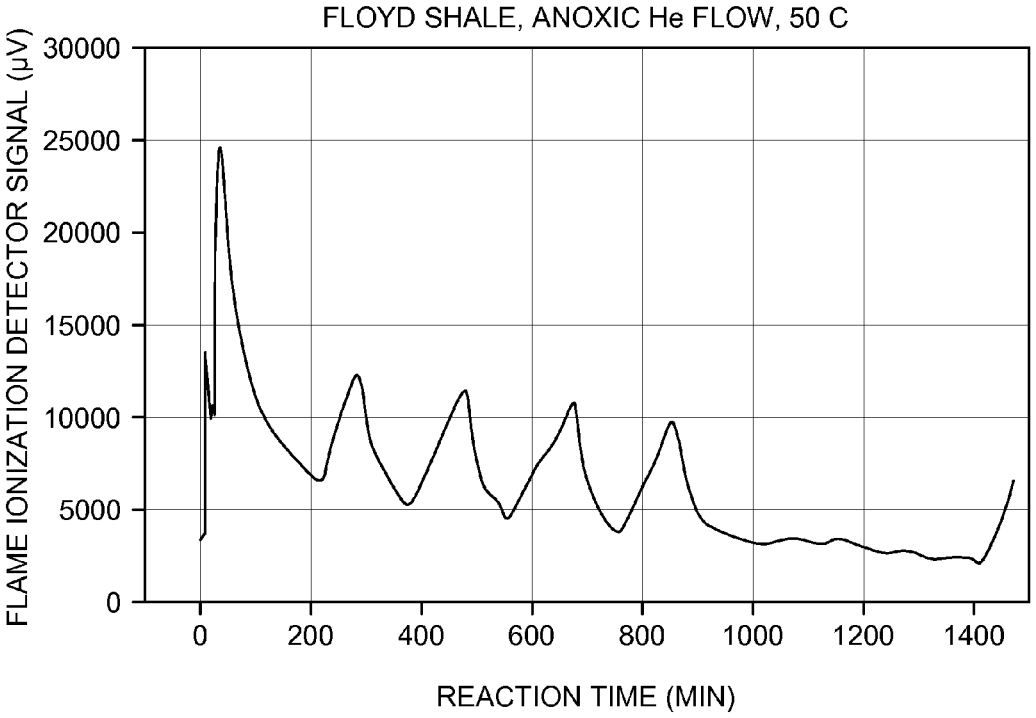
FIG. 7 is a plot depicting chaotic fluctuations in generation of natural gas is a Floyd shale in a laboratory experiment which is proposed to be indicative of hydrogen starvation.

Detecting Chaotic Fluctuations—According to one or more aspects of the invention it is believed that the catalytic reaction is a nonlinear complex system, and can enter into periods of chaos depending on system conditions. These sorts of fluctuations have been observed in laboratory experiments of shale generation of natural gas (FIG. 7), but attribution to hydrogen starvation was not disclosed (Mango & Jarvie, 2009, *Geochemical Transactions* 10:3). It is now believed that the chaotic fluctuations in well production rates, the methane compositions produced, and the reservoir (e.g., subterranean formation) temperatures are indicative of hydrogen starvation in the formation.

Declines in the Ratio of Methane/C2-C6 Over Time—According to one or more aspects of the invention, it has been realized that the catalytic systems across shale formations are heterogeneous in a number of ways. One tool for characterizing a shale's catalytic system is a plot of the ratio of C1/C2+ over time. First, these curves are diagnostic for catalysis as they fit sigmoid functions tightly—this reflects an autocatalytic system and rules out desorption, which follows an exponential function. Furthermore, the inventor has observed distinctions in these curves across different shale formations. Some shale formations have C1/C2+ ratios that slope up over time, whereas others slope down. It is proposed herein that the positive sloping C1/C2+ ratios are indicative of shale formations that have sufficient access to hydrogen. Similarly, it is proposed that negative sloping C1/C2+ ratios are indicative of shale formations that are hydrogen starved, as indicated by their trend toward higher hydrocarbons and thus hydrogen conservation.

Increase in Olefin Concentrations in Produced Gas/Light Oil—According to one or more aspects of the present invention, an increase in olefins produced can be indicative of hydrogen starvation in the formation and therefore the potential for sudden failure of the well penetrating the formation. It is asserted that chemical reactions occurring in the formation in the absence of hydrogen produce olefins.

Decrease in Hydrogen Partial Pressure—According to one or more aspects of the invention, molecular hydrogen may be a factor in the catalytic generation of hydrocarbons in the formation and therefore a decrease in hydrogen partial pressures can be indicative hydrogen starvation and/or the availability of hydrogen in the formation.

Based on one or more of these diagnostic tests being positive, the well (e.g., the subterranean formation) can be considered in danger of hydrogen starvation and thus of sudden failure. Remedial actions (e.g., wellbore operations) may be initiated to avoid or mitigate the sudden failure.

Injecting Methane into the Subterranean Formation—According to one or more aspects of the invention, methane is a hydrogen carrier to the catalytic reaction, and reverses hydrogen starvation.

Raising the Methane Pressure in the Subterranean Formation—According to one or more aspects of the invention, shutting-in a well in, or choking production valves to restrict flow from the well, to increase the methane pressure in the subterranean formation can promote the desired catalytic generation. Increasing methane availability in the formation may provide more hydrogen to the catalyst and therefore the catalytic reaction.

Injecting Hydrogen into the Subterranean Formation—Directly injecting hydrogen gas into the subterranean formation can remedy hydrogen starvation according to one or more aspects of the invention.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for generating gas in a subterranean formation, comprising:

injecting a hydrocarbon gas to a subterranean source rock;

producing a hydrocarbon product from the subterranean source rock generated in response to catalytic activity in the source rock; and detecting hydrogen starvation in the subterranean source rock, comprising one selected from a group of detecting a declining ratio of methane to C2-C6 in the produced gas over time, detecting an increase in olefins produced over time, and detecting a decrease in hydrogen partial pressure over time.

2. The method of claim 1, wherein the injected hydrocarbon gas comprises methane.

3. The method of claim 1, wherein the injected hydrocarbon gas is comprised of between about 10 percent to 90 percent methane.

4. The method of claim 1, wherein the source rock comprises a gas-prone shale.

5. The method of claim 1, wherein the source rock comprises total organic carbon greater than about 0.5 percent.

6. The method of claim 1, wherein the source rock comprises free hydrocarbons greater than about 1 mg/g and the unconverted kerogen greater than about 1 mg/g.

7. The method of claim 1, wherein the source rock comprises total organic carbon greater than about 0.5 percent, free hydrocarbons greater than about 1 mg/g and the unconverted kerogen greater than about 1 mg/g.

8. The method of claim 1, further comprising remedying the hydrogen starvation, wherein the remedying comprises one selected from the group comprising increasing the methane in the subterranean shale formation, injecting methane into the subterranean shale formation, and injecting hydrogen into the subterranean shale formation.

9. A method of producing gas from a subterranean shale formation, comprising:

detecting hydrogen starvation in the shale formation comprising one selected from a group of detecting a declining ratio of methane to C2-C6 in the produced gas over time, detecting an increase in olefins produced over time, and detecting a decrease in hydrogen partial pressure over time; and remedying the hydrogen starvation.

10. The method of claim 9, wherein remedying the hydrogen starvation comprises one selected from the group comprising increasing the methane in the subterranean shale formation, injecting methane into the subterranean shale formation, and injecting hydrogen into the subterranean shale formation.

* * * * *